US006283577B1

(12) United States Patent
Kosaka et al.

(10) Patent No.: US 6,283,577 B1
(45) Date of Patent: Sep. 4, 2001

(54) INK JET RECORDING APPARATUS AND METHOD OF FLUSHING A RECORDING HEAD OF THE SAME

(75) Inventors: Zenta Kosaka; Nobutoshi Otsuka, both of Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/422,504

(22) Filed: Oct. 21, 1999

(30) Foreign Application Priority Data

Oct. 29, 1998 (JP) ..... 10-309040

(51) Int. Cl.[7] ..... B41J 2/165
(52) U.S. Cl. ..... 347/35; 347/36
(58) Field of Search ..... 347/35, 36

(56) References Cited

FOREIGN PATENT DOCUMENTS 0 616 893 * 9/1994 (EP) .
7-009712 1/1995 (JP) .
7-017087 1/1995 (JP) .

* cited by examiner

*Primary Examiner*—N. Le
*Assistant Examiner*—Shih-wen Hsieh
(74) *Attorney, Agent, or Firm*—Hogan & Hartson, LLP.

(57) ABSTRACT

An ink jet recording apparatus and a method of flushing a recording head of the same are provided. A recording medium is fed along a predetermined feeding passage in a predetermined feeding direction. An ink jet recording head is arranged in a manner movable along a with of the recording medium, in directions orthogonal to the predetermined feeding direction, for effecting printing on the recording medium while moving within a range of printing motion which is larger than a width of the recording medium. Further, the ink jet recording head is controlled such that the ink jet recording head ejects ink droplets toward an area aside from the recording medium within the range of printing motion to carry out a flushing operation of ejecting ink droplets regardless of contents to be printed during a printing process.

4 Claims, 6 Drawing Sheets

INK JET RECORDING APPARATUS AND METHOD OF FLUSHING A RECORDING HEAD OF THE SAME

BACKGROUND OF THE INVENTION

1. Field of the Invention

This invention relates to an ink jet recording apparatus and a method of flushing a recording head of the same.

2. Prior Art

Conventionally, in an ink jet recording apparatus, when a predetermined time period elapses after execution of print processing, a flushing operation is carried out by ejecting ink droplets from nozzles of a recording head, so as to prevent the nozzles from being clogged. In the case of carrying out the flushing operation in the conventional ink jet recording apparatus, as shown in FIG. 1, a carriage 101 having a recording head 100 mounted thereon is moved to a position above a capping device 102 arranged in a non-printing region outside a range of motion of the carriage 101 for printing and then ink droplets are ejected toward the capping device 102. The range of motion of the carriage 101 for printing is a range within which the carriage 101 moves to effect printing on a recording medium 103. The range has opposite side zones thereof spreading outwardly from locations opposed to respective opposite side edges of the recording medium 103 such that the range includes regions through which the carriage 101 passes during its acceleration/deceleration and regions for carrying out an off-area printing, i.e. printing effected on a side edge of the recording medium 103 and an area outward of the same.

In the conventional ink jet recording apparatus, however, when a flushing operation is carried out during execution of the printing process, it is required to move the carriage 101 from the range of motion for printing to the non-printing region for flushing, and then return the carriage 101 to the range of motion for printing, so as to resume printing. Therefore, a time period required for the printing process is inevitably prolonged.

SUMMARY OF THE INVENTION

It is an object of the invention to provide an ink jet recording apparatus and a method of flushing a recording head of the ink jet recording apparatus which make it possible to carry out flushing without suspending a printing process.

To attain the above object, according to a first aspect of the invention, there is provided an ink jet recording apparatus comprising:

feeding means for feeding a recording medium along a predetermined feeding passage in a predetermined feeding direction;

an ink jet recording head arranged in a manner movable along a width of the recording medium, in directions orthogonal to the predetermined feeding direction, for effecting printing on the recording medium fed by the feeding means while moving within a range of printing motion which is larger than the width of the recording medium; and control means for controlling the ink jet recording head such that the ink jet recording head ejects ink droplets toward an area outside the recording medium within the range of printing motion, to carry out a flushing operation of ejecting ink droplets regardless of contents to be printed, during a printing process.

Preferably, the ink jet recording apparatus further comprises an ink absorber arranged at a location opposed to the ink jet recording head via the predetermined feeding passage, for absorbing ink droplets ejected from the ink jet recording head during execution of the flushing operation.

Preferably, the recording medium is a tape-like recording medium.

More preferably, the tape-like recording medium includes a printing surface having a predetermined width and a waste ink-absorbing surface formed along at least one side edge of the printing surface, and the control means controls the ink jet recording head such that ink droplets are ejected toward the waste ink-absorbing surface during execution of the flushing operation.

Preferably, the control means causes the ink jet recording head to carry out the flushing operation during motion of the ink jet recording head for printing.

To attain the above object, according to a second aspect of the invention, there is provided a method of carrying out flushing of an ink jet recording head of an ink jet recording apparatus by ejecting ink droplets regardless of contents to be printed during a printing process, the ink jet recording apparatus including feeding means for feeding a recording medium along a predetermined feeding passage in a predetermined feeding direction, and the ink jet recording head arranged in a manner movable along a width of the recording medium, in directions orthogonal to the predetermined feeding direction, for effecting printing on the recording medium fed by the feeding means while moving within a range of printing motion which is larger than the width of the recording medium.

The method is characterized in that the ink jet recording head ejects ink droplets toward an area outside the recording medium within the range of printing motion.

Preferably, the flushing is carried out during motion of the ink jet recording head for printing.

The above and other objects, features, and advantages of the invention will become apparent from the following detailed description taken in conjunction with the accompanying drawings.

DETAILED DESCRIPTION

The invention will now be described in detail with reference to the drawings showing an embodiment thereof.

Figure 1:
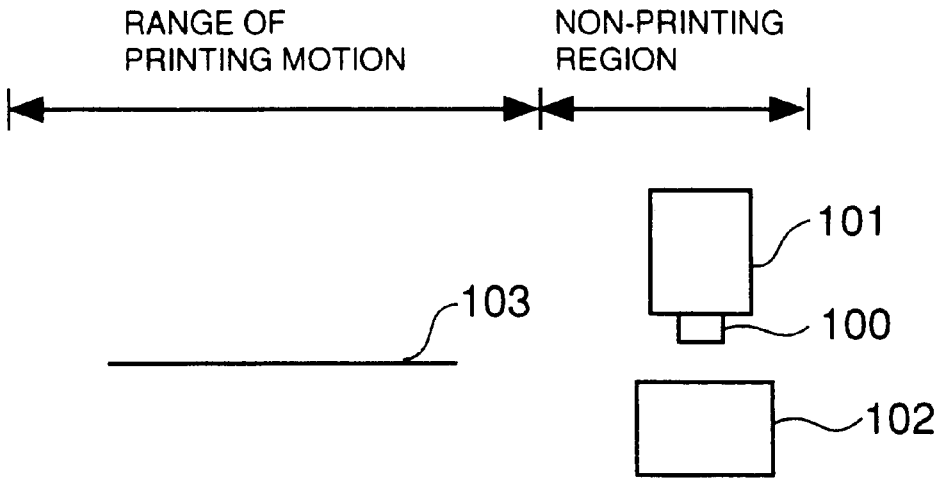
FIG. 1 is a view which is useful in explaining a region in which a flushing operation is performed by a conventional ink jet recording apparatus.
Figure 2:
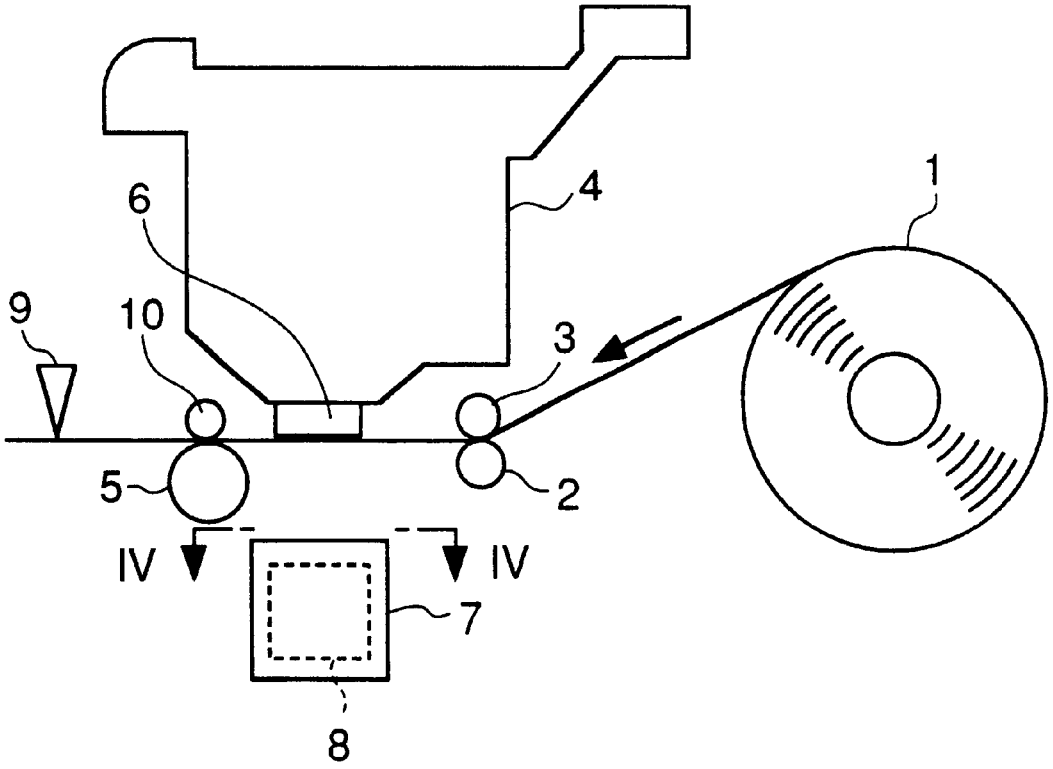
FIG. 2 is a view schematically showing the arrangement of an ink jet recording apparatus according to an embodiment of the invention.

Referring first to FIG. 2, there is schematically shown the arrangement of an ink jet recording apparatus according to the embodiment. Reference numeral 1 in the figure designates a roll of a tape (recording medium) on which the ink jet recording apparatus effects printing. Although in the present embodiment, the tape 1 has an underside surface thereof coated e.g. with an adhesive layer which is covered by a release paper, this is not limitative, but a tape sheet having no adhesive layer or release paper may be used as the recording medium.

On a left side of the roll of the tape 1, as viewed in FIG. 2, there are arranged a carrier roller 2 and a tape-retaining roller 3 in a manner opposed to each other, and the tape 1 is fed through a nip between the two rollers 2 and 3. In this construction, a motor, not shown, causes the carrier roller 2 and a feed roller 5 to perform counterclockwise rotation as viewed in the figure, whereby the tape 1 is drawn and advanced along a predetermined feeding passage in a direction indicated by an arrow along the tape. Thus, in the present embodiment, feeding means is comprised of the carrier roller 2, the tape-retaining roller 3, the feed roller 5, and a tape-retaining roller 10.

A carriage 4 is arranged at a location downstream of the carrier roller 2 and the tape-retaining roller 3 in the tape-feeding direction. Mounted on a surface of the carriage 4 opposed to the feeding passage along which the tape 1 is fed is a recording head (ink jet recording head) 6 including an array of nozzles each having an opening for ejecting ink droplets therefrom. Further, the carriage 4 has an ink cartridge, not shown, mounted therein for delivering ink to the recording head 6. Pressure applied to ink droplets e.g. by a piezo-electric element or a heating element, to eject the ink droplets from the nozzle openings for printing or flushing.

Figure 3:
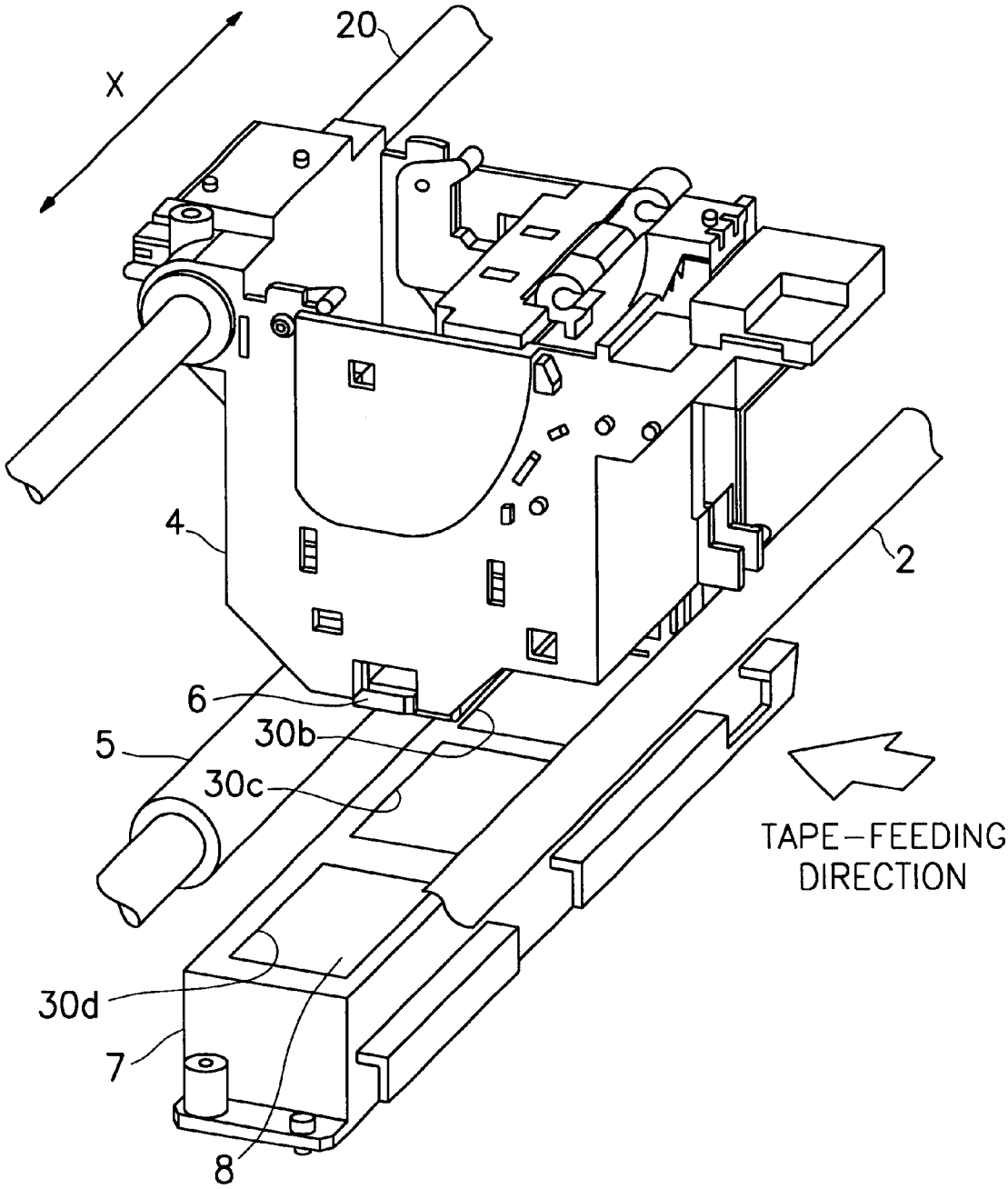
FIG. 3 is a perspective view of a printing mechanism of the FIG. 2 ink jet recording apparatus and component parts associated therewith.

Referring next to FIG. 3, there are shown a printing mechanism and component parts associated therewith. As shown in the figure, the carriage 4 is supported by a shaft 20 extending along a width of the tape 1, i.e. orthogonally to the tape-feeding direction. Further, the carriage 4 is connected to a timing belt, not shown, which is moved by rotation of a carriage-driving motor 50 (see FIG. 5), referred to hereinafter. The carriage 4 is movable along an axis of the shaft 20 as indicated by a double-headed arrow X in FIG. 3.

Figure 4:
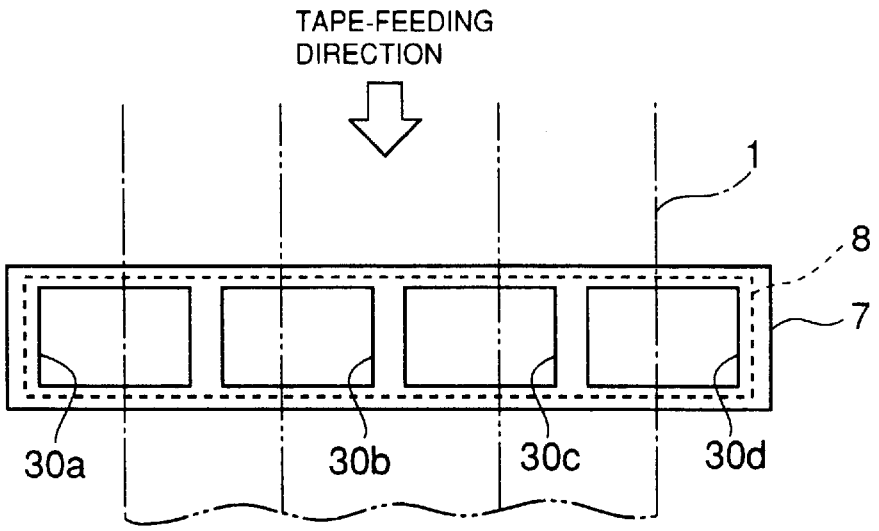
FIG. 4 is a sectional view taken on line IV—IV of FIG. 2.

As shown in FIGS. 2 and 3, a box-shaped ink absorber case 7 accommodating an ink absorber 8 is arranged at a location opposed to the recording head 6 via the feeding passage of the tape 1, i.e. a location below the recording head 6. FIG. 4 is a view taken on line IV—IV of FIG. 2. As shown in the figure, a surface of the ink absorber case 7 opposed to the recording head 6, i.e. an upper surface of the same is formed with a plurality of (four in the figure) openings 30*a*, 30*b*, 30*c*, 30*d*. The ink absorber 8 is exposed through the openings toward the recording head 6 arranged above the ink absorber case 7, to absorb ink droplets ejected from the nozzles of the recording head 6 arranged above the ink absorber case 7.

The ink absorber case 7 is in the form of a rectangular parallelepiped longitudinally extending in the directions in which the carriage 4 can move and having a length which is larger than the width of the tape 1 indicated by one-dot chain lines in FIG. 4. The ink absorber case 7 is arranged such that opposite end portions thereof spread outwardly off respective side edges of the tape 1. The ink absorber 8 has a shape generally similar to that of the ink absorber case 7. When flushing, described in detail hereinafter, is carried out, ink droplets ejected from the nozzles in the recording head 6 pass through the openings 30*a* and 30*d* spreading outwardly off the respective side edges of the tape 1, to be absorbed in the ink absorber 8. It should be noted that the tape 1 indicated by the one-dot chain lines in FIG. 4 is a tape having a maximum size or width which can be dealt with by this ink jet recording apparatus, and hence it is possible to use tapes having smaller widths. For example, when a tape indicated by two-dot chain lines which is smaller in width than the tape 1 ejected by the one-dot chain lines is used, ink droplets ejected from the nozzles in the recording head 6 for flushing pass through the openings 30*b* and 30*c* to be absorbed in the ink absorber 8.

Referring again to FIG. 2, a cutter 9 is arranged at a location downstream of the feed roller 5 in the tape-feeding direction. A printed portion of the tape 1 is cut off by the cutter 9 to be discharged from the ink jet recording apparatus.

Figure 5:
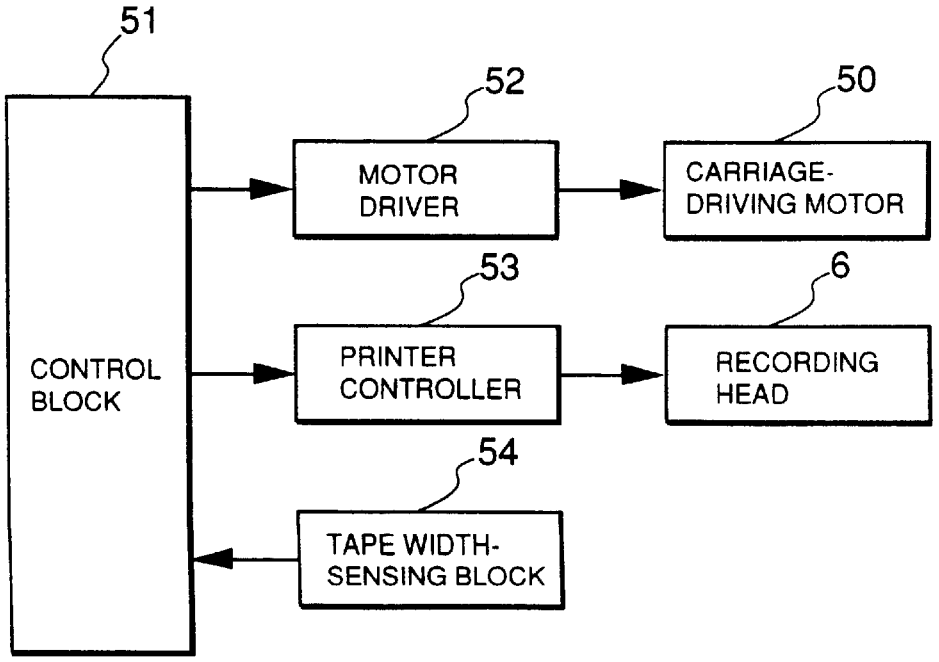
FIG. 5 is a block diagram showing the arrangement of a control system of the FIG. 2 ink jet recording apparatus.

Next, a control system of the ink jet recording apparatus will be described with reference to FIG. 5. As shown in the figure, the control system is comprised of a control block (control means) 51, a motor driver 52, a printer controller 53, and a tape width-sensing block 54. The control block 51 including a CPU, a ROM, and a RAM controls various blocks of the ink jet recording apparatus, based on control programs stored in the ROM, for execution of a printing operation, a flushing operation, described in detail hereinafter, and so forth. The motor driver 52 controls a carriage-driving motor 50 in response to an instruction issued from the control block 51 to thereby cause the motor 50 to move the carriage 4 e.g. in accordance with a printing operation. The printer controller 53 controls the recording head 6 for execution of the printing operation, in response to an instruction issued from the control block 51 based on print data. The tape width-sensing block 54 senses the width of a tape 1 used in the ink jet recording apparatus. The tape width-sensing block 54 can be implemented by a known tape width-sensing mechanism which is comprised of an optical sensor, a mechanical sensor, or the like.

Next, the operation of the ink jet recording apparatus constructed as above will be described. In the ink jet recording apparatus, whenever a predetermined time period (e.g. 10 seconds) elapses after the start of printing, a flushing operation for preventing clogging of nozzles which have not been used during the printing is carried out by ejecting ink droplets from all the nozzles in the recording head 6 irrespective of contents of an image to be outputted by printing. Now, description will be made of a range within which the carriage 4 and the recording head 6 installed on the carriage 4 move for printing, prior to description of a procedure of the flushing operation, i.e. the method of flushing the recording head according to the present embodiment.

Figure 6:
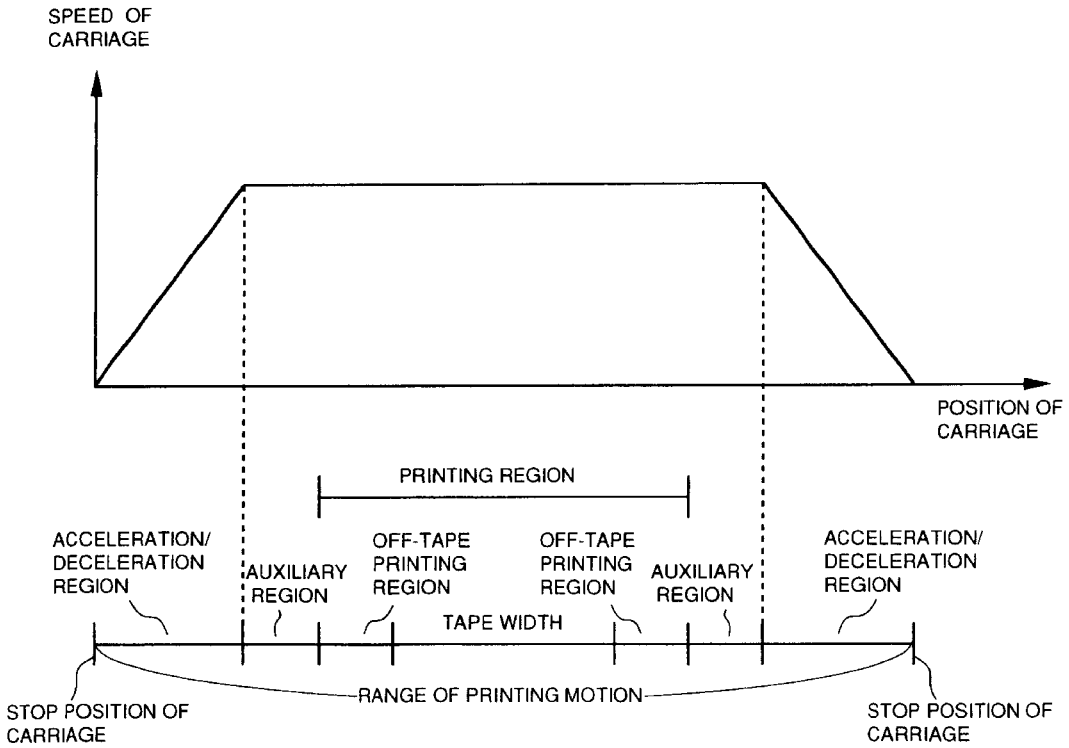
FIG. 6 is a diagram which is useful in explaining a range of printing motion of a carriage which is an essential component part of the FIG. 2 ink jet recording apparatus.

During printing, the carriage 4 ejects ink droplets toward the tape 1 while moving along the width of the same. When printing is carried out by ejecting ink droplets toward the tape 1, the carriage is required to move at a fixed speed. Therefore, as shown in FIG. 6, the range of motion of the carriage 4 for printing is required to include an acceleration region for accelerating the carriage 4 to the fixed speed and a deceleration region for decelerating the carriage 4 moving at the fixed speed to stoppage. Further, according to the ink jet recording apparatus of the invention, a region in which the carriage 4 moves at the fixed speed includes off-tape printing regions allowing off-tape printing to be effected on the tape 1, and auxiliary regions as well. That is, during printing, the carriage 4 reciprocates within the range (hereinafter referred to as "the range of printing motion") of a printing region formed by adding the off-tape printing regions to the tape width sensed by the tape width-sensing block 54 plus the auxiliary regions plus the acceleration/deceleration regions. It should be noted that the term "off-tape printing" means a printing operation for ejecting ink droplets onto a side edge portion of the tape 1 as well as an area spreading off the side edge portion, so as to apply ink all over the side edge portion of the tape 1. The off-tape printing region is not required to be set when no off-tape printing is to be carried out.

Figure 7:
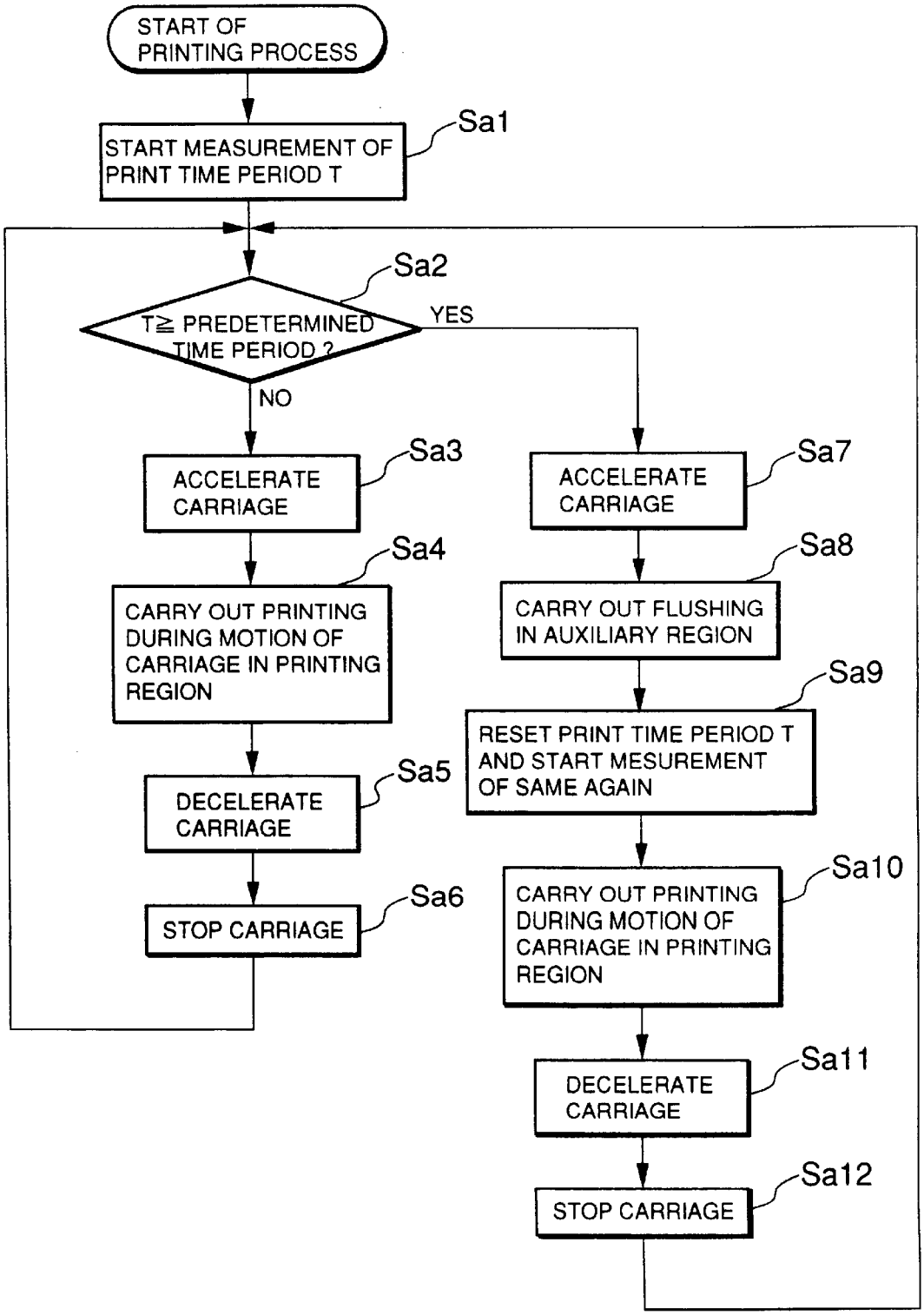
FIG. 7 is a flowchart showing a routine for a printing process executed by the FIG. 2 ink jet recording apparatus.

As described above, in the ink jet recording apparatus, the range of printing motion is determined according to the width of a tape in use, and then the printing process is carried out. As shown in FIG. 7, when the printing process is started, the control block 51 starts measuring a print time period T (step Sa1). If the print time period T measured at this time point is shorter than a predetermined time period (e.g. 10 seconds) (step Sa2), the carriage 4 is accelerated from its stop position (step Sa3), whereby a printing operation is started. The carriage 4 accelerated to a predetermined speed passes through one of the auxiliary regions, and then enters the printing region. While moving in the printing region, the carriage 4 performs printing in a predetermined manner by ejecting ink droplets from the recording head 6 (step Sa4). After the carriage 4 passes through the other auxiliary region, deceleration of the carriage 4 is started in an adjacent one of the acceleration/deceleration regions (step Sa5), until the carriage 4 is stopped (step Sa6).

When the carriage 4 has performed a one-way motion (one pass) through the range of printing motion to thereby carry out printing, the program returns to the step Sa2, wherein it is determined whether or not the print time period T is equal to or longer than the predetermined time period. If the print time period T is equal to or longer than the predetermined time period, the carriage 4 is accelerated (step Sa7) similarly to the case of the normal printing described above. Then, the carriage 4 accelerated to the predetermined speed carries out flushing (step Sa8) by ejecting ink droplets from the nozzles of the recording head 6 while passing through a corresponding one of the auxiliary regions. When the flushing is completed in the corresponding auxiliary region, the control block 51 resets the print time period T being measured to start measuring the print time period T again from scratch (step Sa9). Then, the control block 51 causes ink droplets to be ejected from the nozzles of the recording head 6 to carry out printing in a predetermined manner (step Sa10) when the carriage 4 is moving in the printing region. When the printing is completed and the carriage 4 has passed through the auxiliary region, deceleration of the carriage 4 is started in the acceleration/deceleration region (step Sa11), until the carriage 4 is stopped (step Sa12).

As described above, according to the ink jet recording apparatus of the present embodiment, when the print time period T becomes equal to or longer than the predetermined time period, i.e. when periodic flushing is required, a printing operation including a flushing operation is carried out. On the other hand, in the conventional ink jet recording apparatuses, ink droplets are ejected toward a capping device or the like which is arranged in an area outside the range of printing motion of a carriage 4. Therefore, in order to perform flushing, it is required to suspend printing and move the carriage 4 to a location opposed to the capping device. In the printing operation including the flushing operation which is carried out by the ink jet recording apparatus of the embodiment, flushing is performed when the carriage 4 is moving in the auxiliary region. As a result, the printing operation including the flushing operation can be carried out over the same time period as is required for a normal printing operation without any flushing operation. Thus, in the present embodiment, there is no need to suspend printing for flushing, which contributes to reduction of time required for printing.

Further, in the embodiment, since ink droplets ejected in the auxiliary regions are directed toward the ink absorber 8, it is possible to prevent the ink from being spattered within the apparatus.

The present invention is not limited to the above embodiment, but variations as described below are possible.

Although in the above embodiment, printing is effected during the reciprocating motion (i.e. both forward motion and backward motion) of the carriage 4, ink droplets may be ejected for printing only during the forward motion of the carriage 4 (the motion of the same from a right side to a left side as viewed in FIG. 6). In this case, a flushing operation is also performed only during the forward motion of the carriage 4, and the carriage moves backward without ejecting any ink droplets.

Further, in the above embodiment, flushing is carried out when the carriage 4 is moving in the auxiliary regions, but flushing may be performed when the carriage 4 is being accelerated or decelerated in the respective acceleration/deceleration regions. In this case, each of the auxiliary regions can be reduced, and hence the range of printing motion of the carriage 4 can also be shortened. This makes it possible to further shorten the time period required for printing.

Figure 8:
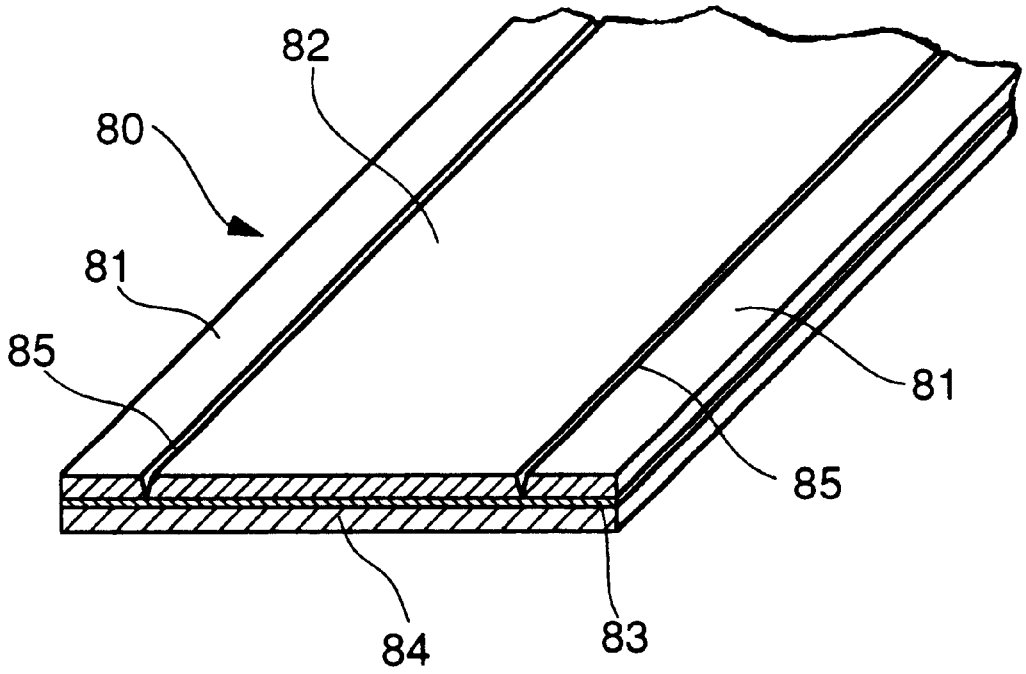
FIG. 8 is a partial perspective view showing the structure of a tape used in a variation of the FIG. 2 ink jet recording apparatus.

Further, although in the above embodiment, waste ink resulting from droplets ejected in flushing is absorbed by the ink absorber 8, a tape 80 formed with waste ink-absorbing surfaces 81 shown in FIG. 8 may be used as a printing tape, so as to absorb the waste ink by the waste ink-absorbing surfaces 81. As shown in the figure, the tape 80 has a three-layer structure having a top layer formed by an image-receiving layer 82 and the waste ink-absorbing surfaces 81, an adhesive layer 83 coated on an underside surface of the top layer, and a release paper 84 peelably covering the adhesive layer 83. The waste ink-absorbing surfaces 81 are formed along respective opposite side edges of the image-receiving layer 82. Further, there are formed two cut lines 85 along boundaries between the image-receiving layer 82 and the respective waste ink-absorbing surfaces 81. This construction of the tape 80 makes it possible to peel off the image-receiving layer 82 alone from the release paper 84 and dispose of the waste ink-absorbing surfaces 81, the adhesive layer 83, and the release paper 84 after completion of printing.

The use of the tape 80 having the above structure makes it possible to dispense with the ink absorber 8 or the like for absorbing waste ink produced by flushing, to thereby simplify the construction of the ink jet recording apparatus.

Figure 9:
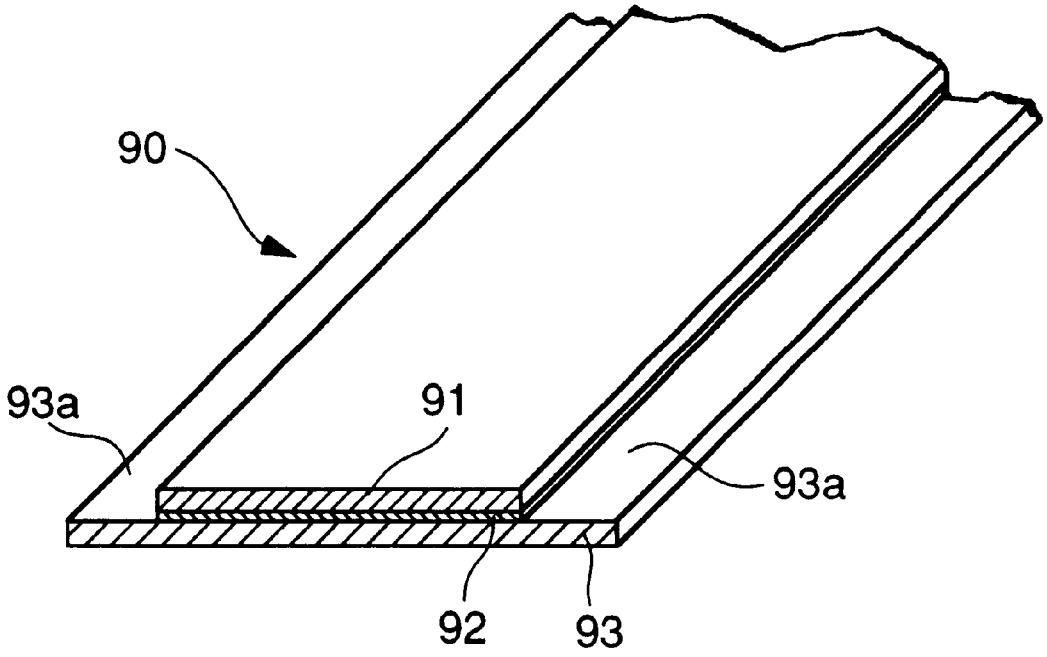
FIG. 9 is a partial perspective view showing the structure a tape used in another variation of the FIG. 2 ink jet recording apparatus.

Alternatively, a tape having a structure shown in FIG. 9 maybe used as a printing tape. The tape 90 has a three-layer structure having a top layer formed by an image-receiving layer 91, an adhesive layer 92 coated on an underside surface of the image-receiving layer 91, and a release paper 93 peelably covering the adhesive layer 93. The release paper 93 is formed to be larger in width than the adhesive layer 92 and the image-receiving layer 91, and opposite side portions (waste ink-absorbing surfaces) 93*a* of the release paper 93 each have a surface thereof exposed toward the recording head 6. The exposed side portions 93*a* are formed of a material excellent in absorbency and capable of absorbing waste ink produced by the flushing.

The use of the tape 90 having the above structure makes it possible to dispense with the ink absorber 8 or the like for absorbing waste ink produced by flushing, to thereby simplify the construction of the ink jet recording apparatus.

Further, although in the above embodiment, flushing is carried out in one of the auxiliary regions through which the carriage 4 passes after being accelerated to move to the printing region, it may be carried out in the other of the same through which the carriage 4 passes after having performed printing in the printing region.

Still further, although in the above embodiment, a flushing operation is performed during a printing operation, it may be carried out separately from the printing operation. In this case, it is required to suspend printing so as to carry out flushing. However, since there is no need to move the carriage 4 out of the range of printing motion as in the prior art, a time period during which printing is suspended due to execution of the flushing can be shortened.

Although in the above embodiment, the present invention is applied to a label printer using a tape as the recording medium, this is not limitative, but the invention can also be applied to an ink jet recording apparatus of a type which is capable of carrying out printing e.g. on an A4-size cut sheet or a B5-size cut sheet.

Further, the invention can be applied to other types of ink jet recording apparatuses employing various recording methods already proposed, such as methods utilizing pressure control, thermal control, etc.

It is further understood by those skilled in the art that the foregoing is a preferred embodiment of the invention, and that various changes and modifications may be made without departing from the spirit and scope thereof.

What is claimed is:

1. An ink jet recording apparatus comprising:

feeding means for feeding a recording medium along a predetermined feeding passage in a predetermined feeding direction;

an ink jet recording head arranged in a manner movable along a width of said recording medium, in directions orthogonal to said predetermined feeding direction, for effecting printing on said recording medium fed by said feeding means while moving within a range of printing motion which is larger than said width of said recording medium; and control means for controlling said ink jet recording head such that said ink jet recording head ejects ink droplets toward an area outside said recording medium within said range of printing motion, to carry out a flushing operation of ejecting ink droplets regardless of contents to be printed, during a printing process;

wherein said recording medium is a tape-like recording medium which includes a printing surface having a predetermined width and a waste ink-absorbing surface formed along at least one side edge of said printing surface, and said control means control said ink jet recording head such that ink droplets are ejected toward said waste ink-absorbing surface during execution of said flushing operation.

2. An ink jet recording apparatus according to claim 1, wherein said control means causes said ink jet recording head to carry out said flushing operation during motion of said ink jet recording head for printing.

3. A method of carrying out flushing of an ink jet recording head of an ink jet recording apparatus by ejecting ink droplets regardless of contents to be printed during a printing process, said ink jet recording apparatus including feeding means for comprising the steps of:

feeding a recording medium along a predetermined feeding passage in a predetermined feeding direction, and said ink jet recording head which is arranged in a manner movable;

moving an ink jet recording head along a width of said recording medium, in directions orthogonal to said predetermined feeding direction, for effecting printing on said recording medium fed by said feeding means while moving within a range of printing motion which is larger than said width of said recording medium, and wherein controlling said ink jet recording head eject to eject ink droplets toward an area outside said recording medium within said range of printing motion, to carry out a flushing operation of ejecting ink droplets regardless of contents to be printed during a printing process, wherein the recording medium is a tape-like recording medium which includes a printing surface having a predetermined width and a waste ink-absorbing surface formed along at least one side edge of said printing surface, and the step of controlling the ink jet recording head causes ink droplets to be ejected toward said waste ink-absorbing surface during execution of said flushing operation.

4. A method according to claim 3, wherein said method of carrying out flushing is carried out during motion of said ink jet recording head for printing.

* * * * *